US007075401B2

(12) United States Patent
Fujiyama et al.

(10) Patent No.: US 7,075,401 B2
(45) Date of Patent: Jul. 11, 2006

(54) SMALL-DIAMETER IGNITION COIL

(75) Inventors: Norihito Fujiyama, Obu (JP); Jyunichi Wada, Chita-gun (JP); Kazutoyo Osuka, Handa (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 11/000,266

(22) Filed: Dec. 1, 2004

(65) Prior Publication Data

US 2005/0122196 A1 Jun. 9, 2005

(30) Foreign Application Priority Data

Dec. 3, 2003 (JP) ..... 2003-404744
Oct. 1, 2004 (JP) ..... 2004-290161

(51) Int. Cl.
*H01F 27/30* (2006.01)

(52) U.S. Cl. ..... 336/198; 336/206

(58) Field of Classification Search ..... 336/90–96, 336/192, 198, 206–208; 123/634–635
See application file for complete search history.

(56) References Cited

U.S. PATENT DOCUMENTS 3,559,134 A * 1/1971 Daley ..... 336/96
4,857,877 A * 8/1989 Dethienne ..... 336/170
5,485,135 A * 1/1996 Hipp ..... 336/96
5,736,917 A * 4/1998 Kawano et al. ..... 336/90
6,456,181 B1 * 9/2002 Nakamura ..... 336/96
6,457,229 B1 * 10/2002 Kanazawa et al. ..... 29/602.1

FOREIGN PATENT DOCUMENTS

JP 9-199353 7/1997
JP 2003-232272 8/2003

* cited by examiner

*Primary Examiner*—Tuyen T Nguyen
(74) *Attorney, Agent, or Firm*—Nixon & Vanderhye PC

(57) ABSTRACT

A small-diameter ignition coil includes a center core, a primary coil, a secondary coil, and a thin film tube. The primary and secondary coils are arranged on an outer circumferential side with respect to the center core. The thin film tube has a cylindrical shape. The thin film tube is arranged on an outer circumferential side with respect to one of the primary coil and the secondary coil that is arranged on an outer circumferential side with respect to the other of the primary coil and the secondary coil. The thin film tube is thermally resistive and electrically insulative. The thin film tube has wall thickness that is equal to or less than 0.35 mm. An electrically insulative resin is filled in a gap formed between the thin film tube and one of the primary coil and the secondary coil, which is radially adjacent to the thin film tube.

21 Claims, 6 Drawing Sheets

SMALL-DIAMETER IGNITION COIL

CROSS REFERENCE TO RELATED APPLICATIONS

This application is based on and incorporates herein by reference Japanese Patent Applications No. 2003-404744 filed on Dec. 3, 2003 and No. 2004-290161 filed on Oct. 1, 2004.

FIELD OF THE INVENTION

The present invention relates to a small-diameter ignition coil for a vehicular internal combustion engine.

BACKGROUND OF THE INVENTION

In an ignition coil, high voltage current is generated using an igniter to spark an ignition plug. A conventional ignition coil shown in FIG. 5 has a resinous cylindrical case 80 that forms an outer shell of the ignition coil. The resinous cylindrical case 80 receives a center core 82, a secondary spool 83, a primary spool 86 and an outer core 89 that are coaxially arranged. A secondary coil 84 is wound on the secondary spool 83. A primary coil 87 is wound on the primary spool 86. The outer core 89 is located on the circumferentially outer side of the case 80.

A present engine valve structure 115 shown in FIG. 7 has a water jacket 117 that is jumboized to enhance cooling capacity of the ignition plug, which is inserted and secured to a plughole 119, to improve fuel efficiency and engine power. In this structure, the plughole 119 needs to be small sized. Specifically, the inner diameter of the plug hole 119 is conventionally set between 23 mm and 25 mm, however, the inner diameter of a plug hole 119 is presently demanded to be less than 20 mm.

In a conventional ignition coil according to JP-A-2003-232272, a cylindrical case is provided on the circumferentially outer side of a primary coil. Specifically, in the conventional ignition coil shown in FIG. 5, the cylindrical case 80, which is arranged on the circumferentially outer side of the primary coil 87, has large wall thickness that is between 0.6 mm and 1.2 mm. Therefore, it is difficult to reduce the outer diameter of the ignition coil, i.e., the inner diameter of the plughole to be less than 22 mm in this conventional structure.

As shown in FIG. 6, in a conventional ignition coil according to JP-A-9-199353, a cushion sheet 112 is arranged on the radially inner side with respect to an outer core 109. Specifically, a center core 100, which partially forms a closed magnetic passage, a primary coil 103, a secondary coil 106 and the outer core 109 are arranged from the center to the outer circumferential periphery. The cushion sheet 112 is made of an aramid polymer paper, and is inserted into the inner circumferential space of the outer circumferential core 109.

Thickness of the cushion sheet 112 is not specifically described in JP-A-9-199353, however, the cushion sheet 112 needs sufficient thickness to obtain sufficient shock-absorbing property. The thickness of the cushion sheet 112 may be an obstacle to reduction of the diameter of the ignition coil.

SUMMARY OF THE INVENTION

In view of the foregoing problems, it is an object of the present invention to produce a small-diameter ignition coil inserted into a small diametric plughole on an internal combustion engine.

According to the present invention, a small-diameter ignition coil includes a center core, a primary coil, a secondary coil, and a thin film tube. The primary coil is arranged on the outer circumferential side with respect to the center core. The secondary coil is arranged on the outer circumferential side with respect to the center core. The thin film tube has a cylindrical shape. The thin film tube is arranged on the outer circumferential side with respect to one of the primary coil and the secondary coil that is arranged on the outer circumferential side with respect to the other of the primary coil and the secondary coil. The thin film tube is thermally resistive and electrically insulative. The thin film tube has wall thickness that is equal to or less than 0.35 mm.

Alternatively, a cylindrical portion, which is a resinous thin cylindrical wall, may be provided in the small-diameter ignition coil instead of the thin film tube.

Alternatively, a small-diameter ignition coil includes a center core, a primary coil, a secondary coil, an outer core, and a thin film tube. The primary coil is arranged on the outer circumferential side with respect to the center core. The secondary coil is arranged on the outer circumferential side with respect to the center core. The outer core has a cylindrical shape. The outer core is arranged on the outer circumferential side with respect to one of the primary coil and the secondary coil that is arranged on the outer circumferential side with respect to the other of the primary coil and the secondary coil. The thin film tube has a cylindrical shape. The thin film tube is arranged on the outer circumferential side with respect to the outer core. The thin film tube is thermally resistive and electrically insulative. The thin film tube has wall thickness that is equal to or less than 0.35 mm.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

Figure 1:
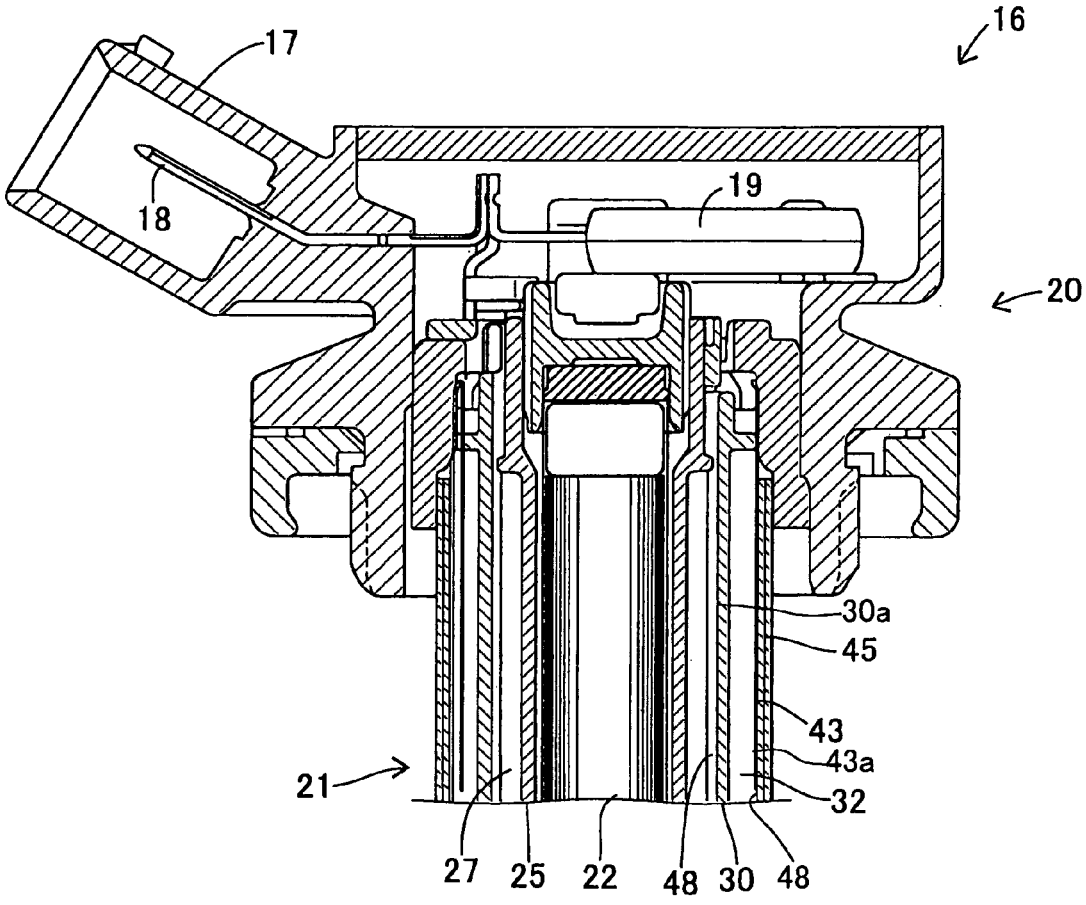
FIG. 1 is a partially cross-sectional side view showing an upper portion of an ignition coil according to a first embodiment of the present invention.

An ignition coil 20 shown in FIG. 1 is electrically connected to an ignition plug that is secured to a plughole formed in a cylinder of an engine (not shown).

The ignition coil 20 has a coil portion 21 that is located axially between an intermediate portion of the plughole and an inlet hole of the plughole. The lower end portion of the ignition coil 20 is connected with the ignition plug via a high voltage tower portion (not shown). The ignition plug is covered with a cap (not shown), to which the high voltage tower portion is connected.

The ignition coil 20 has a control portion 16 that is mounted on the upper face of a cylinder block of the engine. The control portion 16 has a connector 17, in which a terminal 18 is electrically connected with an igniter 19 that are embedded in electrically insulating resin.

The coil portion 21 of the ignition coil 20 receives a center core 22, a secondary spool 25, a secondary coil 27, a primary spool 30, a primary coil 32, a cylindrical thin film tube 43, and an outer core 45 in the order from the center to the circumferentially outer side of the coil portion 21. The secondary coil 27 is wound on the outer circumferential periphery of the secondary spool 25, which has a cylindrical shape and is electrically insulative. The primary coil 32 is wound on the outer circumferential periphery of the primary spool 30, which has a cylindrical shape and is electrically insulative. The primary spool 30 is arranged coaxially with respect to the secondary spool 25. The upper end portion of the high voltage tower portion on the lower side in FIG. 1 is integrally formed with the lower end portion of the primary spool 30.

Figure 2A:
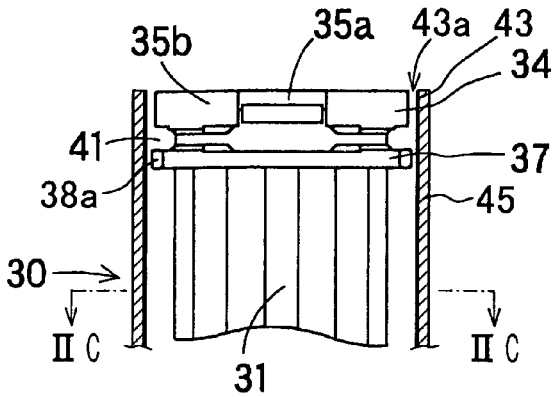
FIG. 2A is a partially cross-sectional side view showing an upper portion of a primary spool.
Figure 2C:
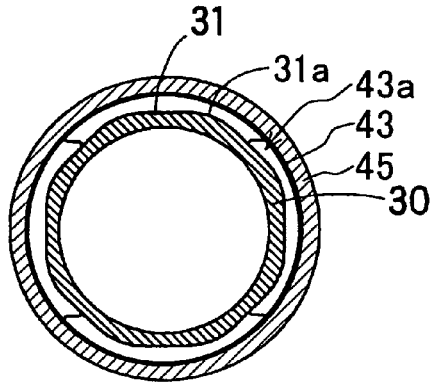
FIG. 2C is a partially cross-sectional top view showing the primary spool taken along the line IIC–IIC in FIG. 2A.
Figure 2B:
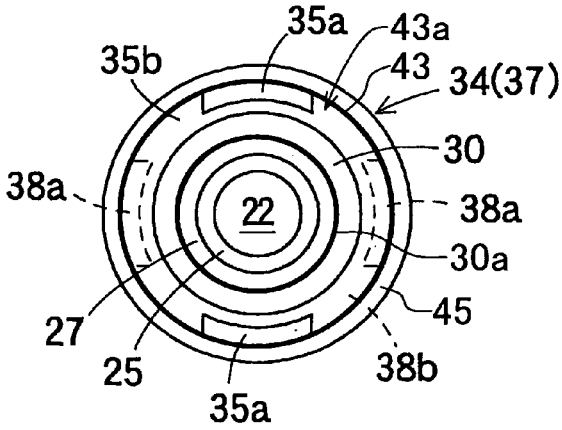
FIG. 2B is a top view showing the primary spool.

As shown in FIGS. 2A, 2B, the upper end portion of the primary spool 30 on the opposite side as the ignition plug has a first collar portion 34 and a second collar portion 37 that are axially separated from each other. The first and second collar portions 34, 37 form an annular groove 41 therebetween. The first collar portion 34 has multiple grooves 35*a* that respectively have a predetermined circumferential length. The grooves 35*a* are circumferentially separated from each other, so that the grooves 35*a* and brim portions 35*b* are alternatively arranged in the circumferential direction. The second collar portion 37 has multiple grooves 38*a* that respectively have a predetermined circumferential length. The grooves 38*a* are circumferentially separated from each other, so that the grooves 38*a* and brim portions 38*b* are alternatively arranged in the circumferential direction, in the same manner as that of the first collar portion 34.

Figure 2D:
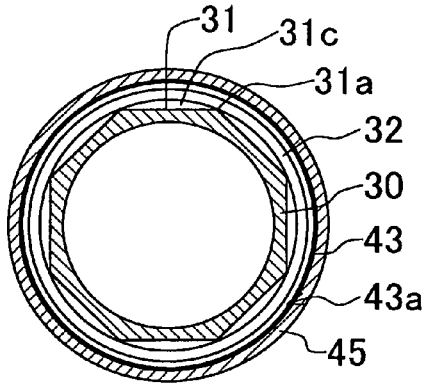
FIG. 2D is a cross-sectional top view showing the primary spool, in which a primary coil is circumferentially wound.

The grooves 38*a* of the second collar portion 37 is staggered with respect to the grooves 35*a* of the first collar portion 34 by substantially 90° in the circumferential direction. That is, the grooves 38*a* of the second collar portion 37 is rotated with respect to the grooves 35*a* of the first collar portion 34 by substantially 90° in the circumferential direction. Thus, the grooves 35*a* of the first collar portion 34, the annular groove 41 and the grooves 38*a* of the second collar portion 37 are communicated with each other to form a labyrinth-like space. As shown in FIG. 2C, the primary spool 30 has a substantially octagonal shaped hollow axial section. The radially outer face of the primary spool 30 has eight rectangular flat faces 31. As shown in FIG. 2D, the primary coil 32 is circumferentially wound on the outer eight rectangular flat faces 31 of the primary spool 30. The secondary coil 27 and the primary spool 30 form arch-shaped circumferential gaps 31*c* therebetween, and electrically insulative resin 48 (FIG. 1) is filled into the circumferential gaps 31*c*. The primary coil 32 and the thin film tube 43 form a circumferential gap 43*a* therebetween, into which electrically insulative resin 48 is filled. Here, a radially central portion of the ignition coil 20 is not shown in FIGS. 2C, 2D. The outer core (circumferentially outer core) 45, which is arranged on the most outer circumferential position of the coil portion 21, has a cylindrical shape that is about 21.5 mm in outer diameter. The outer diameter of the outer core 45 is the diameter of the ignition coil 20.

The cylindrical thin film tube 43 is attached to the inner circumferential side of the cylindrical outer core 45 in an assembling process of the ignition coil 20. Subsequently, the center core 22, the secondary spool 25, on which the secondary coil 27 is wound, the primary spool 30, on which the primary coil 32 is wound, are inserted into the hollow space coaxially formed in the thin film tube 43 and the outer core 45, and are positioned with respect to each other. That is, the center core 22, the secondary coil 27 and the primary coil 32 are circumferentially covered with the thin film tube 43 and the outer core 45.

Electrically insulative resin 48, which is in molten state, is filled into gaps such as a circumferential gap 30*a* (FIG. 2B), which is formed between the secondary coil 27 and the primary spool 30, and the circumferential gap 43*a*, which is formed between the primary coil 32 and the thin film tube 43. As shown in FIG. 2D, the primary coil 32 contacts edge portions 31*a* of the primary spool 30, in which circumferentially adjacent flat faces 31 are connected with each other, so that the arch-shaped circumferential gaps 31*c* are formed between the flat faces 31 and the primary coil 32.

Figure 3:
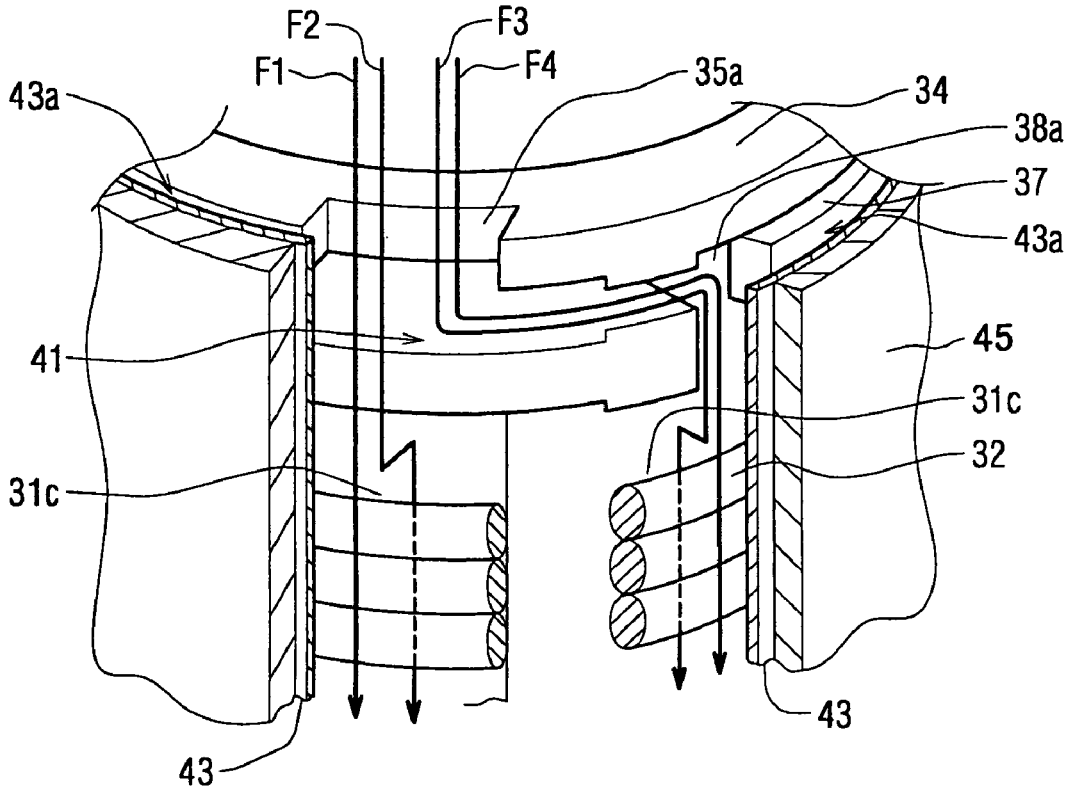
FIG. 3 is a partially cross-sectional perspective view showing a resinous flow around the primary spool and the primary coil.

As shown in FIG. 3, the thin film tube 43 and the first collar portion 34 form a small circumferential gap 43*a* therebetween. Similarly, the thin film tube 43 and the second collar portion 37 form the small circumferential gap 43*a* therebetween.

Molten electrically insulative resin 48 is injected from the grooves 35*a* of the first collar portion 34 into the inner space of the thin film tube 43, as shown by arrows F1 to F4 in FIG. 3. The molten resin flow is divided into first flows F1, F2 and second flows F3, F4.

The second flows F3, F4 are introduced into the arch-shaped circumferential gaps 31*c* and the small circumferential gap 43*a* through the labyrinth-like space, which is formed of the groove 35*a* of the first collar portion 34, the annular groove 41, the groove 38*a* of the second collar portion 37. The flow F3 is introduced into the arch-shaped circumferential gaps 31*c*. Besides, the first flows F1, F2 are introduced into the arch-shaped circumferential gaps 31*c* and the small circumferential gap 43*a* through the small circumferential gap 43*a* formed between the thin film tube 43 and the second collar portion 37. The flow F2 is introduced into the arch-shaped circumferential gaps 31*c*.

When each groove 35*a* of the first collar portion 34 and each groove 38*a* of the second collar portion 37 are arranged to be in straight in the axial direction, molten resin straightly flows along the grooves 35*a*, 38*a*. In this structure, molten resin may not be sufficiently distributed to a circumferentially intermediate portion between the grooves 35*a*, 38*a* that are circumferentially adjacent to each other.

On the contrary, in the structure shown in FIG. 3, the molten resin flow F1, F2, F3, F4 passing through the groove 35*a* collides against the upper face of the second collar portion 37 on the upper side in FIG. 3. The small circumferential gap 43*a* is appropriately set with respect to the cross sectional area of both the annular groove 41 and the grooves 38*a* in consideration of viscosity of the molten resin, so that the molten resin flow can be substantially uniformly divided into the first flows F1, F2 and the second flows F3, F4. Therefore, the molten resin can be sufficiently distributed uniformly into the gaps among the thin film tube 43, the primary coil 32 and the primary spool 30 in the inner space of the thin film tube 43. Besides, molten resin can be simultaneously injected into the circumferential gap 30*a* (FIG. 2B), which is formed between the secondary coil 27 and the primary spool 30. In this structure, the electrically insulative resin 48 is filled in the arch-shaped circumferential gaps 31*c*, so that the thin film tube 43, the primary coil 32 and the primary spool 30 are further steadily bonded with each other. Besides, the electrically insulative resin 48 filled in the arch-shaped circumferential gaps 31*c* has radial thickness, so that the thin film tube 43 can be further reinforced with the electrically insulative resin 48.

Thus, the ignition coil 20 does not need a conventional resinous thick-walled case (FIG. 5), so that the ignition coil 20 is reduced in diameter, and the ignition coil 20 is reduced in weight by approximately 35%. The ignition coil 20 does not need a flange that is secured to the engine, so that manufacturing process for securing the ignition coil 20 to the engine can be reduced.

Figure 5:
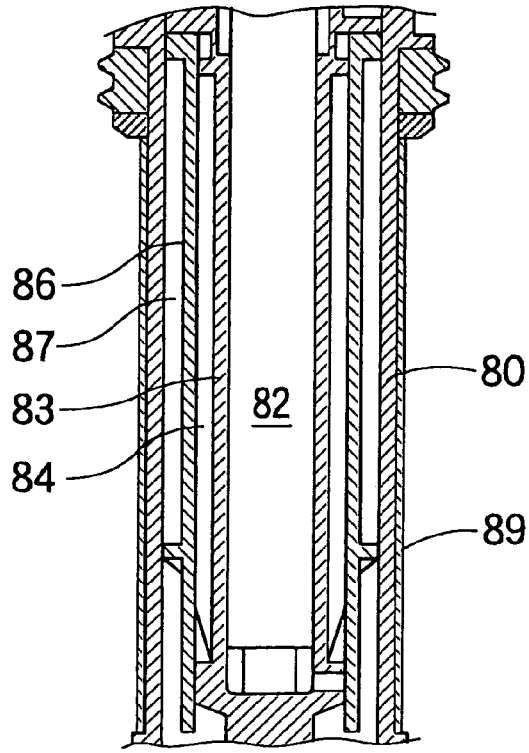
FIG. 5 PRIOR ART
FIG. 5 is a partially cross-sectional side view showing an upper portion of an ignition coil according to a first prior art.

In the present invention, the thin film tube 43A is used in the ignition coil 20, instead of a conventional resinous thick-walled case 80 (FIG. 5). A thin-walled tube, a thin-walled cylinder or a thin-walled pipe can be used in the ignition coil 20 instead of the thin film tube 43A.

Theoretically, wall thickness of the primary and secondary spools 30, 25 may be reduced to decrease the diameter of the ignition coil 20, however, wall thickness of the primary and secondary spools 30, 25 is already substantially minimum in a conventional structure of the ignition coil. Accordingly, further reduction of the wall thickness of the primary and secondary spools 30, 25 is difficult.

However, the thin film tube (thin-walled tube) 43 receives the primary and secondary spools 30, 25, and the thin film tube 43 is used as a case in which electrically insulative resin 48 is filled in the gap formed among the center core 22, the primary and secondary spools 30, 25, in the ignition coil 20 of the present invention. The thin film tube 43 and the inner components are steadily secured and integrated with each other to be one piece via the electrically insulative resin 48, so that the integrated coil portion 21 may have high mechanical strength, even mechanical strength of the thin film tube 43 is low before the assembling process.

Furthermore, the thin film tube 43 may be used as an anti-rust member for the outer circumferential core 45.

Figure 6:
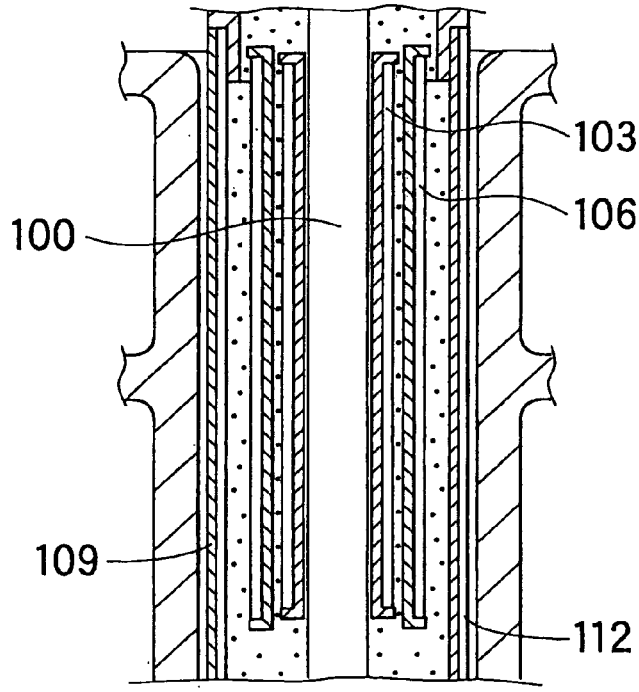
FIG. 6 PRIOR ART
FIG. 6 is a partially cross-sectional side view showing an upper portion of an ignition coil according to a second prior art.
Figure 7:
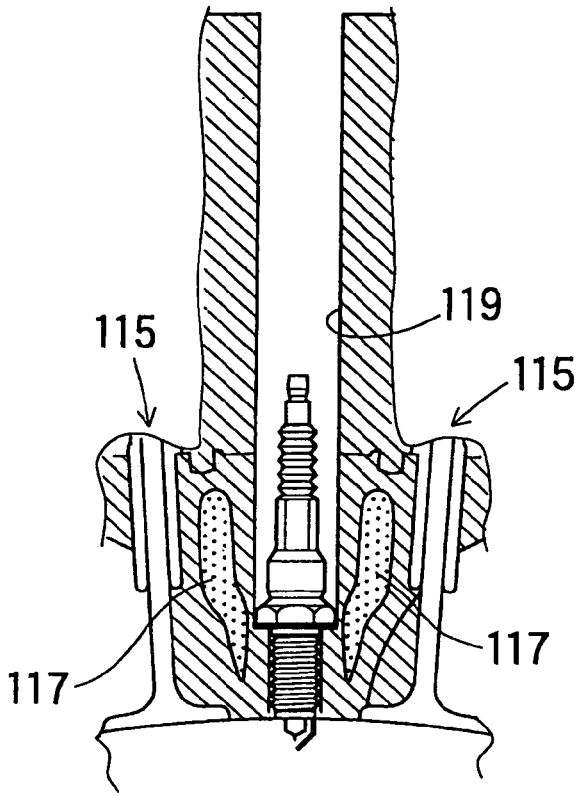
FIG. 7 RELATED ART
FIG. 7 is a partially cross-sectional side view showing an ignition coil inserted into a plughole according to a related art.

The thin film tube 43 has wall thickness that is equal to or less than 0.35 mm. Wall thickness of the thin film tube 43 is much smaller than wall thickness of the conventional resinous thick-walled case 80 (FIG. 5) and the conventional cushion sheet 112 (FIG. 6). Therefore, the outer diameter of the ignition coil 20 can be significantly reduced, so that the small-diameter ignition coil 20 can be inserted into a small-diameter plughole. Furthermore, the thin film tube 43 is electrically insulative, so that the primary coil 32 and a cylinder block of the engine can be electrically insulated from each other without an additional insulating member. The thin film tube 43 is thermally resistive, so that the thin film tube 43 can be protected from deforming and deteriorating due to heat generated in the engine operation.

The electrically insulative resin 48 is filled in the gap formed between the thin film tube 43 and the primary coil 32 that are adjacent to each other. The electrically insulative resin 48 is also used as a thermally radiative member as well as an electrically insulative member. That is, the electrically insulative resin 48 electrically insulates between the thin film tube 43 and the primary coil 32. Besides, heat generated in the primary and secondary spools 30, 25 can be radiated to the outer side of the coil portion 21 via the electrically insulative resin 48.

The outer core 45 arranged on the outer circumferential side with respect to the thin film tube 43 forms a closed magnetic passage in conjunction with the center core 22.

The outer diameter of the outer core 45 is equal to or less than 21.5 mm in the ignition coil 20 of the present invention. Therefore, the small-diameter ignition coil 20 can be inserted into a small-diameter plughole that is equal to or less than 22 mm in diameter.

The outer core 45 may not be provided to the ignition coil 20. Besides, a thin-walled resinous cylinder (cylindrical portion) 43, which has a resinous thin-walled cylindrical circumferential periphery, may be used instead of the thin film tube 43 in the ignition coil 20.

Here, a first type of the small-diameter ignition coil (first-type ignition coil) 20 is constructed of the center core 22, the primary and secondary coils 32, 27, and the thin film tube 43 without the outer core 45. In this structure, the thin film tube 43 is arranged on the most outer circumferential side of the ignition coil 20. Even in this structure, the thin film tube 43 is reinforced by the electrically insulative resin 48, so that the thin film tube 43 can be a circumferentially outer shell of the ignition coil 20. A second type of the small-diameter ignition coil (second-type ignition coil) 20 is constructed of the center core 22, the primary and secondary coils 32, 27, the thin film tube 43, and the outer core 45. A third type of the small-diameter ignition coil (third-type ignition coil) 20 is constructed of the center core 22, the primary and secondary coils 32, 27, and the thin-walled resinous cylinder 43 instead of the thin film tube 43. In this structure, the thin-walled resinous cylinder 43 is also reinforced by the electrically insulative resin 48, so that the thin-walled resinous cylinder 43 can be a circumferentially outer shell of the ignition coil 20, similarly to the first-type ignition coil 20.

The center core 22 and the outer core 45 may have conventional structures in the first-type, second-type and third-type ignition coils 20. The outer diameter of the ignition coil 20 depends on the outer diameter of a component, which is arranged on the most outer circumferential side of the ignition coil 20. That is, the outer diameter of the first-type ignition coil 20 is the outer diameter of the thin film tube 43. The outer diameter of second-type ignition coil 20 is the outer diameter of the outer core 45. The outer diameter of the third-type ignition coil 20 is the outer diameter of the thin-walled resinous cylinder 43.

Current passing through the primary coil 32 is shut by the igniter 19, and high voltage current is generated in the secondary coil 27 in the first-type, second-type and third-type ignition coils 20. The primary coil 32 is wound on the outer flat faces 31 of the cylindrical primary spool 30 that is electrically insulative.

The secondary coil 27 is wound on the outer circumferential periphery (flat faces) of the cylindrical secondary spool 25 that is also electrically insulative. The primary coil 32 may be arranged on the circumferentially inner side, and the secondary coil 27 may be arranged on the circumferentially outer side, in the radial direction of the ignition coil 20. One of the primary and secondary coils 32, 27, which is arranged on the outer circumferential side with respect to the other of the primary and secondary coils 32, 27, has at least one of a collar portion 34, 37 on the axial end thereof, which is on the opposite side as the ignition plug. Each collar portion 34, 37 has grooves 35*a*, 38*a* that are formed partially in the collar portion 34, 37 in the circumferential direction of the collar portion 34, 37 such that electrically insulative resin 48 is capable of passing through the grooves 35*a*, 38*a*. The grooves 38*a* of the second collar portion 37 is staggered relative to the grooves 35*a* of the first collar portion 34 in the circumferential direction. Thus, flow of the electrically insulative resin 48 can be circumferentially uniformly introduced in the coil portion 21. At least one of the primary and secondary spools 30, 25, which is arranged on the outer circumferential side with respect to the other of the primary and secondary spools 30, 25, has a polygonal cylindrical shape, i.e., a polygonal shape in axial section. Thus, flow of the electrically insulative resin 48 can be introduced into the gaps formed between the one of the primary and secondary spools 30, 25 and one of the primary and secondary coils 32, 27 to reinforce the outer circumferential structure of the ignition coil 20.

The thin film tube 43 may be a heat-shrinkable tube formed of silicone, olefin or fluoroplastic, alternatively, the thin film tube 43 may be constructed of an electrically insulative film formed of polyimide, fluoroplastic, PPS or polyester in the first-type and second-type ignition coils 20. The heat-shrinkable tube and the electrically insulative film can be produced at low cost. The above materials such as silicone, olefin, polyimide, fluoroplastic, PPS (poly phenylene sulfide) and polyester are highly electrically insulative and highly thermally radiative. Heat resistance of the thin film tube 43 is substantially 150° C. The thin film tube 43 can be formed by extrusion or the like.

The thin film tube 43 has a cylindrical shape corresponding to the shapes of primary and secondary coils 32, 27 and the outer core 45 when the thin film tube 43 is assembled to the ignition coil 20. The thin film tube 43 has wall thickness that is equal to or greater than 0.05 mm and is equal to or less than 0.35 mm. Preferably, the wall thickness of the thin film tube 43 is 0.2 mm. When the wall thickness of the thin film tube 43 becomes greater than 0.35 mm, the outer diameter of the ignition coil 20 becomes large. The maximum wall thickness of the thin film tube 43 may be 0.35 mm in consideration of eccentricity of the inner circumferential periphery and the outer circumferential periphery of the thin film tube 43, circularity and straightness of the thin film tube 43, and flash formed in a molding process of the thin film tube 43 with respect to the minimum thickness of 0.05 mm.

A sheet having wall thickness less than 0.05 mm is difficult to produce. Wall thickness of the heat-shrinkable tube 43 formed of thermostable resin such as silicone is preferably equal to or greater than 0.15 mm and equal to or less than 0.35 mm. Wall thickness of cylindrical electrically insulative thin film forming the thin film tube 43 is preferably equal to or greater than 0.05 mm and equal to or less than 0.35 mm.

When the wall thickness of the thin film tube 43 is less than 0.35 mm, heat can be effectively radiated via the thin film tube 43 to the radially outside of the coil portion 21. Specifically, when the thin film tube 43 is arranged between the primary coil 32 and the outer core 45, heat generated in the primary coil 32 can be efficiently radiated to the outer core 45 that is used as a radiating member in the second-type ignition coil 20.

The third-type ignition coil 20 includes the thin-walled resinous cylinder 43 instead of the thin film tube 43. Here, a thin-walled resinous pipe 43 can be used instead of the thin-walled resinous cylinder. The thin-walled resinous cylinder 43 is formed of resin such as PPS (poly phenylene sulfide) or PBT (polybutylene terephthalate) to be in a thin-walled cylindrical shape. The thin-walled resinous cylinder 43 may be injection-molded.

The thin-walled resinous cylinder 43 has wall thickness as substantially the same as the wall thickness of the thin film tube 43, and the thin-walled resinous cylinder 43 is arranged in the same manner as the film tube 43 in the first-type and second-type ignition coils 20. The thin-walled resinous cylinder 43 may be arranged on either of the inner or outer circumferential side of the outer core 45. The thin-walled resinous cylinder 43 may have wall thickness that is equal to or greater than 0.05 mm and is equal to or less than 0.35 mm. Preferably, the wall thickness of the thin-walled resinous cylinder 43 is 0.2 mm.

The thin film tube 43 may be arranged on the outer circumferential side of the outer core 45, or may be arranged on the inner circumferential side of the outer core 45. In either structure, the thin film tube 43 shows an equivalent effect as the resinous thick-walled case 80 in the prior art shown in FIG. 5. Besides, the thin film tube 43 is capable of additional effect in both the above structures. When the thin film tube 43 is arranged on the inner circumferential side of the outer core 45, the thin film tube 43 can be used as the case, in which the electrically insulative resin 48 is filled in the gaps formed among the center core 22, the primary and secondary coils 32, 27.

Second Embodiment

Figure 4:
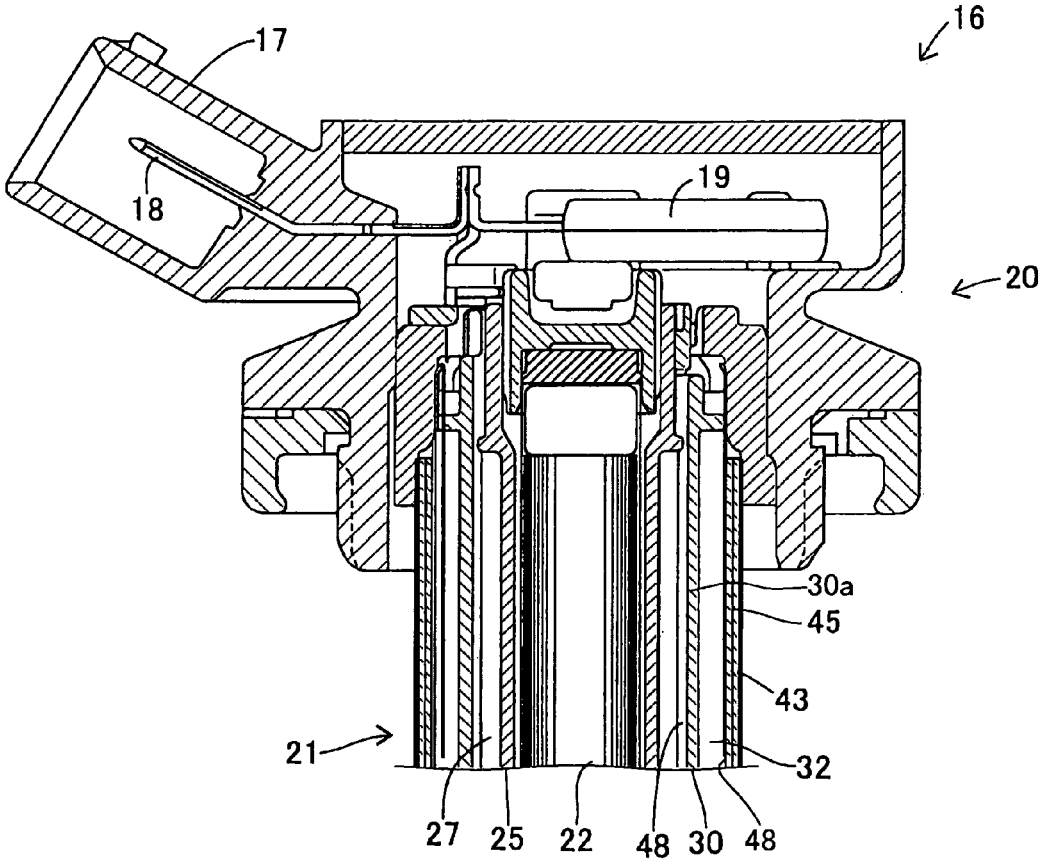
FIG. 4 is a partially cross-sectional side view showing an upper portion of an ignition coil according to a second embodiment of the present invention.

As shown in FIG. 4, when the thin film tube 43 is arranged on the outer circumferential side of the outer core 45, the thin film tube 43 can be used as an antirust cover of the outer core 45. The thin film tube 43 has a thin wall, so that the diameter of the ignition coil 20 does not significantly increase.

Various modifications and alternations may be diversely made to the above embodiments without departing from the spirit of the present invention.

What is claimed is:

1. A small-diameter ignition coil comprising:

a center core;

a primary coil that is arranged on an outer circumferential side with respect to the center core;

a secondary coil that is arranged on the outer circumferential side with respect to the center core;

a thin film tube that has a cylindrical shape, the thin film tube arranged on an outer circumferential side with respect to one of the primary coil and the secondary coil that is arranged on an outer circumferential side with respect to the other of the primary coil and the secondary coil;

a first spool that has a cylindrical shape on which the one of the primary coil and the secondary coil is wound; and an electrically insulative resin filled in a gap formed between the thin film tube and the one of the primary coil and the secondary coil, wherein the thin film tube is thermally resistive and electrically insulative, the first spool has at least one collar portion that opposes the thin film tube in a radial direction of the first spool, the thin film tube forms a cylindrical wall that accommodates the center core, the primary coil, the secondary coil, and the electrically insulative resin, and the thin film tube has a wall thickness that is equal to or less than 0.35 mm.

2. The small-diameter ignition coil according to claim 1, wherein the first spool is one of a primary spool, on which the primary coil is wound, and a secondary spool, on which the secondary coil is wound, and further comprising:

a second spool that is the other of the primary spool and the secondary spool, wherein one of the primary spool and the secondary spool, which is arranged on an outer circumferential side with respect to the other of the primary spool and the secondary spool, has an outer face forming a polygonal cylindrical shape.

3. The small-diameter ignition coil according to claim 2, wherein the at least one collar portion is arranged on an axial end of the first spool, and the collar portion defines a groove in a circumferential direction of the collar portion such that an electrically insulative resin is capable of passing through the groove.

4. The small-diameter ignition coil according to claim 1, further comprising:

an outer core that has a cylindrical shape, wherein the outer core is arranged on an outer circumferential side with respect to the thin film tube.

5. The small-diameter ignition coil according to claim 4, wherein the outer core has an outer diameter that is equal to or less than 21.5 mm.

6. The small-diameter ignition coil according to claim 1, wherein the thin film tube is one of:

a silicone heat-shrinkable tube;

an olefinic heat-shrinkable tube;

a fluoric heat-shrinkable tube; and an electrically insulative film formed of one of polyimide, fluoroplastic, PPS, and polyester.

7. The small-diameter ignition coil according to claim 1, wherein the at least one collar portion includes a first collar portion and a second collar portion, and the first collar portion is distant from the second collar portion with respect to an axial direction of the first spool.

8. The small-diameter ignition coil according to claim 7, wherein the first collar portion has a first groove, the second collar portion has a second groove, and the first groove is distant from the second groove with respect to a circumferential direction of the first spool.

9. The small-diameter ignition coil according to claim 1, wherein the at least one collar portion extends from an outer face of the first spool spaced from the longitudinal ends thereof, in the radial direction of the first spool.

10. A small-diameter ignition coil comprising:

a center core;

a primary coil that is arranged on an outer circumferential side with respect to the center core;

a secondary coil that is arranged on the outer circumferential side with respect to the center core;

a cylindrical portion that has a resinous thin cylindrical wall, the cylindrical portion arranged on an outer circumferential side with respect to one of the primary coil and the secondary coil that is arranged on an outer circumferential side with respect to the other of the primary coil and the secondary coil;

a first spool that has a cylindrical shape on which the one of the primary coil and the secondary coil is wound; and an electrically insulative resin that is filled in a gap formed between the cylindrical portion and the one of the primary coil and the secondary coil, wherein the cylindrical portion is thermally resistive and electrically insulative, the first spool has at least one collar portion that opposes the cylindrical portion in a radial direction of the first spool, the cylindrical portion forms a cylindrical wall that accommodates the center core, the primary coil, the secondary coil, and the electrically insulative resin, and the cylindrical portion has a wall thickness that is equal to or less than 0.35 mm.

11. The small-diameter ignition coil according to claim 10, wherein the cylindrical portion is formed of one of PPS and PBT.

12. The small-diameter ignition coil according to claim 10, wherein the outer core has an outer diameter that is equal to or less than 21.5 mm.

13. The small-diameter ignition coil according to claim 10, wherein the at least one collar portion includes a first collar portion and a second collar portion, and the first collar portion is distant from the second collar portion with respect to an axial direction of the first spool.

14. The small-diameter ignition coil according to claim 13, wherein the first collar portion has a first groove, the second collar portion has a second groove, and the first groove is distant from the second groove with respect to a circumferential direction of the first spool.

15. The small-diameter ignition coil according to claim 10, wherein the at least one collar portion extends from an outer face of the first spool spaced from the longitudinal ends thereof, in the radial direction of the first spool.

16. A method for manufacturing an ignition coil comprising:

providing a center core, a primary coil, a secondary coil, a thin film tube, and a first spool, wherein the primary coil is arranged on an outer circumferential side with respect to the center core, the secondary coil is arranged on the outer circumferential side with respect to the center core, the thin film tube has a cylindrical shape, the thin film tube being arranged on an outer circumferential side with respect to the one of the primary coil and the secondary coil that is arranged on an outer circumferential side with respect to an other of the primary coil and the secondary coil, the first spool that has a cylindrical shape on which the one of the primary coil and the secondary coil is wound, and the first spool has at least one collar portion that opposes to the thin film tube in a radial direction of the first spool, the method further comprising:

filling an electrically insulative resin into the thin film tube through a gap formed between the thin film tube and the collar portion of the first spool.

17. The method according to claim 16, wherein the at least one collar portion has a groove, and the electrically insulative resin is filled into the thin film tube through the groove.

18. The method according to claim 16, wherein the at least one collar portion includes a first collar portion and a second collar portion, the first collar portion has a first groove, the second collar portion has a second groove, the first groove is distant from the second groove with respect to a circumferential direction of the primary spool, and the electrically insulative resin is filled into the thin film tube through the first groove and second groove.

19. A method for manufacturing an ignition coil comprising:

providing a center core, a primary coil, a secondary coil, a cylindrical portion, and a first spool, wherein the primary coil is arranged on an outer circumferential side with respect to the center core, the secondary coil is arranged on the outer circumferential side with respect to the center core, the cylindrical portion has a resinous thin cylindrical wall, the cylindrical portion being arranged on an outer circumferential side with respect to the one of the primary coil and the secondary coil that is arranged on an outer circumferential side with respect to an other of the primary coil and the secondary coil, the first spool that has a cylindrical shape on which the one of the primary coil and the secondary coil is wound, and the first spool has at least one collar portion that opposes to the cylindrical portion in a radial direction of the first spool, the method further comprising:

filling an electrically insulative resin into the cylindrical portion through a gap formed between the cylindrical portion and the collar portion of the first spool.

20. The method according to claim 19, wherein the at least one collar portion has a groove, the electrically insulative resin is filled into the cylindrical portion through the groove.

21. The method according to claim 19, wherein the at least one collar portion includes a first collar portion and a second collar portion, the first collar portion has a first groove, the second collar portion has a second groove, the first groove is distant from the second groove with respect to a circumferential direction of the primary spool, and the electrically insulative resin is filled into the cylindrical portion through the first groove and second groove.

* * * * *